United States Patent [19]

Ginzburg et al.

[11] Patent Number: 4,491,006

[45] Date of Patent: Jan. 1, 1985

[54] METHOD AND APPARATUS FOR COILING STRIP BETWEEN THE ROUGHING TRAIN AND THE FINISHING TRAIN

[75] Inventors: Vladimir B. Ginzburg; John E. Thomas, both of Pittsburgh, Pa.

[73] Assignee: Tippins Machinery Company, Inc., Pittsburgh, Pa.

[21] Appl. No.: 494,614

[22] Filed: May 16, 1983

[51] Int. Cl.[3] ..... B21B 41/00

[52] U.S. Cl. ..... 72/202; 72/227; 72/229; 72/234; 72/252; 242/78.1

[58] Field of Search ..... 72/200, 202, 227, 229, 72/231, 234, 206, 252, 366; 242/78, 78.1, 55

[56] References Cited

U.S. PATENT DOCUMENTS

| | | | |
|---|---|---|---|
| 2,195,008 | 3/1940 | Lessmann | 242/78.1 |
| 3,803,891 | 4/1974 | Smith | 72/231 |
| 4,263,798 | 4/1981 | Wladika et al. | 72/202 |
| 4,319,474 | 3/1982 | Gronbech | 72/231 |
| 4,348,882 | 9/1982 | Tippins | 72/202 |

*Primary Examiner*—Francis S. Husar
*Assistant Examiner*—Steven B. Katz
*Attorney, Agent, or Firm*—Webb, Burden, Robinson & Webb

[57] ABSTRACT

A method of hot rolling strip on a hot strip mill includes coiling on a coiler at least a portion of the transfer bar by initiating coiling at the tail end of the transfer bar after it exits the roughing train and, thereafter, decoiling or paying off the partially formed coil into the finishing stand. The coiler is movable between a first position adjacent the roughing train and a second position adjacent the finishing train. Coil payoff apparatus may be positioned adjacent to an upstream end of the finishing train for receiving the coil from the coiler and paying it off into the finishing train.

11 Claims, 6 Drawing Figures

METHOD AND APPARATUS FOR COILING STRIP BETWEEN THE ROUGHING TRAIN AND THE FINISHING TRAIN

FIELD OF THE INVENTION

Our invention relates to hot strip mills and, more particularly, to coiling the transfer bar in the space between the roughing train and the finishing train and, thereafter, decoiling or paying off into the finishing train.

DESCRIPTION OF THE PRIOR ART

The conventional method of rolling strip on a hot strip mill comprises reducing a preheated slab to strip thicknesses by rolling it through a series of rolling mill stands. The rolling sequence normally takes place in two stages with the first stage being referred to as the roughing train and the second phase being referred to as the finishing train.

The roughing train comprises one or more mill stands in which the incoming slab is reduced in thickness to a transfer bar on the order of one inch thick. Hot reversing mills are commonly used in the roughing train so that a plurality of passes may be taken in a single mill by passing it back and forth therethrough. A roughing train may also include scale breakers and vertical edgers.

After leaving the roughing train the transfer bar is conveyed along table rolls to the finishing train which is normally a continuous finishing mill having a plurality of mill stands. Mill stands in the finishing train are operated in tandem and reduce the transfer bar to strip thickness. The space between the roughing train and finishing train is greater in length than the transfer bar.

Shortcomings of the conventional hot strip mill and method of rolling are well known. One of the problems associated with such a mill and method of rolling is the ability to control thickness because of a temperature difference between the head and tail of the coil. Such temperature differential arises because of the delay times associated with feeding a transfer bar at a relatively slow speed into the finishing train. This temperature differential is accentuated for lighter gauges because of the higher heat transfer rate associated therewith. In order to achieve constant strip thickness it is necessary to maintain a temperature differential within acceptable levels.

In addition to the problems a temperature differential creates in the rolling operation, a considerable amount of secondary scale is formed on the exposed surface of the transfer bar while it is waiting on the delay table in advance of the finishing train.

A number of techniques and equipment have been devised to reduce this temperature differential and they include accelerated rolling, heat shields over the delay table, tapered transfer bars and descaling units ahead of the finishing train. Tunnel furnaces have even been employed.

More recent attempts include coiling the transfer bar out of the roughing mill and, thereafter, decoiling the formed coil into the finishing mill so that there is not a rapid heat loss through the large, exposed area and the retained heat in coil form is intended to compensate for heat losses. Such a system of coiling is known as the coil box. With a coil box it is necessary that the next to the last forward pass in the roughing train produce a workpiece having a length less than the roughing train coil box spacing. This requirement limits the length of the strip that can be rolled or, alternatively, requires an unduly large space between the roughing train and the finishing train, both of which are unacceptable in today's market. U.S. Pat. No. 3,803,891 is illustrative of the coil box concept.

A more recent concept utilizes a coiler which can be moved into an inoperative condition away from the pass line so that the next to the last forward pass may produce a workpiece of a length greater than the coiler roughing mill's spacing. U.S. Pat. No. 4,319,474 illustrates that concept.

All of the intermediate coiler systems have two common characteristics, namely, they create additional delay while coiling is taking place and coiling is initiated from the head end of the coil so when decoiling takes place the net result is to lower the temperature of the entire coil.

SUMMARY OF THE INVENTION

Our invention utilizes all of the advantages of an intermediate coiling operation without incorporating any of the disadvantages. We eliminate time delays associated with coiling and minimize overall temperature loss to the transfer bar being coiled. Further, we provide a system which is amenable to shorter distances between the roughing train and the finishing train rather than a system which dictates larger distances.

Our method of hot rolling strip includes providing a coiler movable in the space between the roughing train and the finishing train from a first position adjacent the roughing train to a second position adjacent the finishing train. Coiling is initiated at the tail end of the transfer bar and the coiler is advanced toward the finishing train concurrently with the rolling of the head end of the transfer bar in the finishing train. The coil may either be decoiled from the coiling means movable between the two positions, or separate payoff means adjacent the finishing train may pay off the formed coil into the finishing train after coiling is complete. Where circumstances dictate the need for a lower temperature, the coil may even be decoiled back into the run out table rather than paying off directly into the finishing train.

DESCRIPTION OF THE PREFERRED EMBODIMENTS

Figure 1:
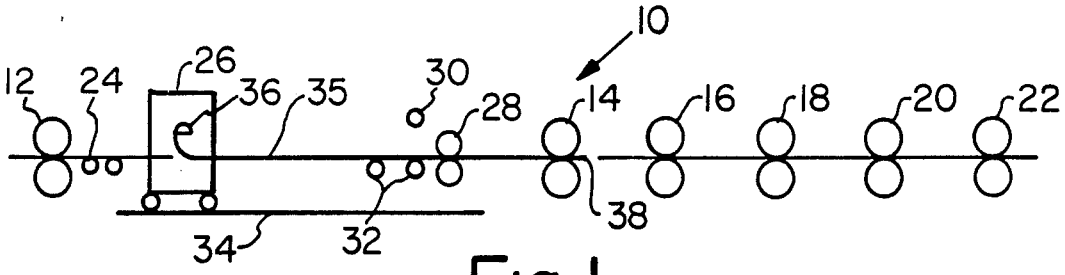
FIG. 1 is a schematic of our hot strip mill showing coiling being initiated at the tail end of the transfer bar.
Figure 2:
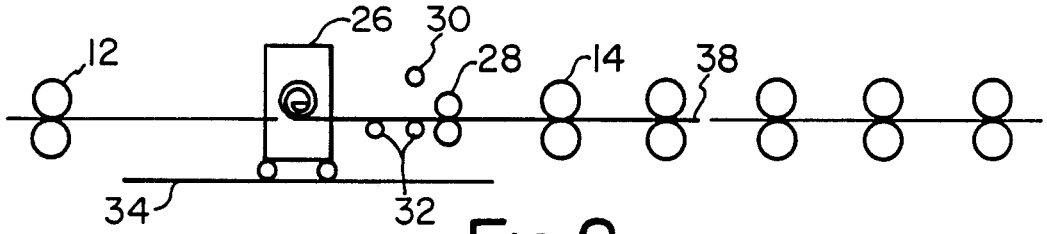
FIG. 2 is a schematic of our hot strip mill showing the coiler at an intermediate coiling position between the roughing train and the finishing train.
Figure 3:
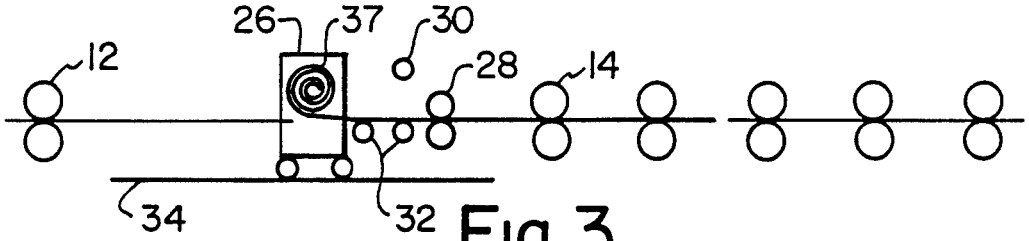
FIG. 3 is a schematic of our hot strip mill showing the coiler having formed a complete coil.
Figure 4:
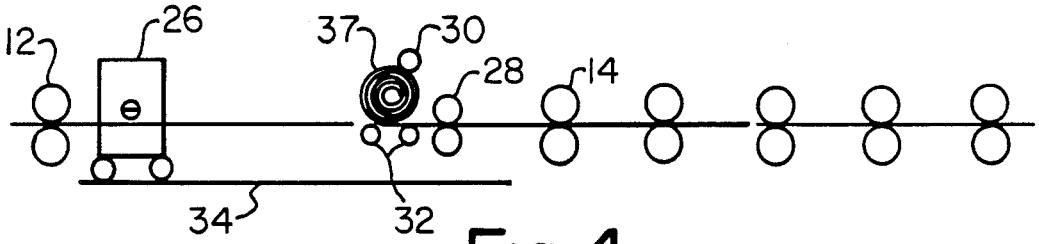
FIG. 4 is a schematic of our hot strip mill showing the completed coil on the payoff means and the coiler returned to its initial position.

Referring to FIGS. 1 through 4 our hot strip mill, generally designated 10, comprises a roughing train made up of hot reversing mill stand 12 and a finishing train made up of five continuous mill stands 14, 16, 18, 20 and 22. Conveyor table rolls 24 define the pass line and transport the transfer bar 35 from hot reversing mill stand 12 to the finishing train mill stand 14.

Coiler 26 is movable along trackway 34 from a first position adjacent reversing mill stand 12 to a second position upstream of and substantially adjacent to finishing stand 14. Also upstream of finishing stand 14 is a flying shear 28 and a payoff roll assembly. The payoff roll assembly comprises bottom cradle rolls 32 and a top hold down roll 30 to accommodate a coil, as will be described hereinafter.

Our method of rolling is as follows: A preheated slab, not shown, is reduced to transfer bar thickness (generally on the order of one inch) by passing it back and forth through hot reversing mill stand 12. After the final pass, transfer bar 35 proceeds along table rolls 24 in the space between roughing mill stand 12 and finishing mill stand 14. Coiler 26 is activated by signal when the tail end 36 of the transfer bar 35 exits the hot reversing mill stand 12. Upon activation coiler 26 picks up the tail end of the transfer bar and coiling is initiated. The head 38 of transfer bar 35 has already been introduced into finishing mill stand 14 and, therefore, the coiler 26 must advance as well as coil. Coiler 26 advances along trackway 34 in speed-coordinated relationship to the movement of the transfer bar 35 into the finishing mill stand 14 so as to form a coil 37 at the same time the transfer bar is being reduced, first through the finishing stand 14 and subsequently through the remainder of the mill stands 16, 18, 20 and 22.

As coiler 26 reaches its forward most position, coil 37 is transferred into the payoff assembly comprised of cradle rolls 32 and hold down roll 30. The coil is thereafter held by the cradle rolls 32 and hold down roll 30 while it pays off into the finishing train. The tail end of the coil is cropped by the crop shear 28 prior to entering the finishing train.

After the coiler 26 is relieved of the coil 37 at the payoff assembly, it returns to its first position adjacent the roughing train where it awaits the next transfer bar therethrough. It will be recognized that the coiler may be utilized to pay off the coil onto the finishing train, but by dispatching the coil to a payoff assembly the coiler can be returned for the next transfer bar without any time delay. A coiler may also be used to decoil back into the run out table where a time delay and resultant temperture drop are desired. All of these systems can be monitored by appropriate temperature sensors and automatically regulated.

Figure 6:
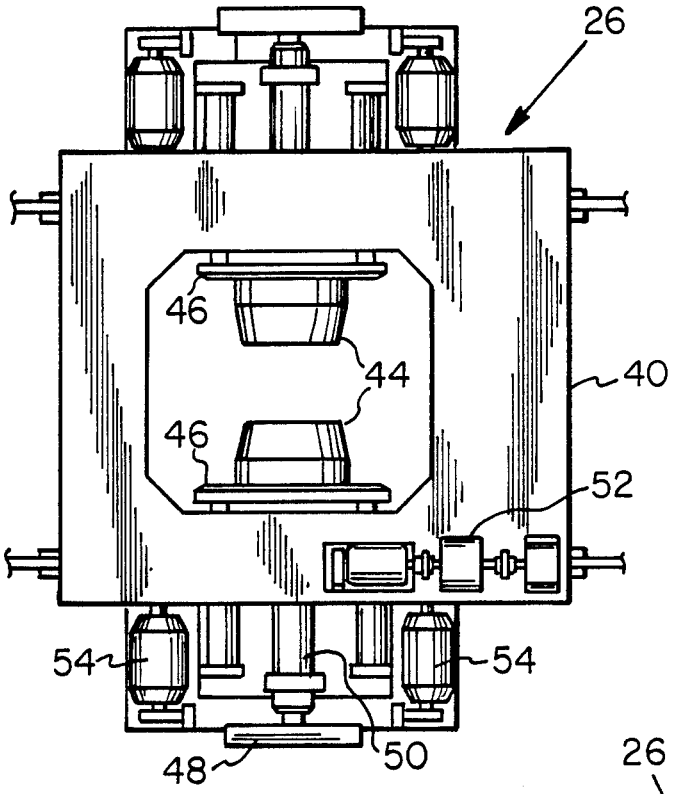
FIG. 6 is a plan view of the coiler of FIG. 5.
Figure 5:
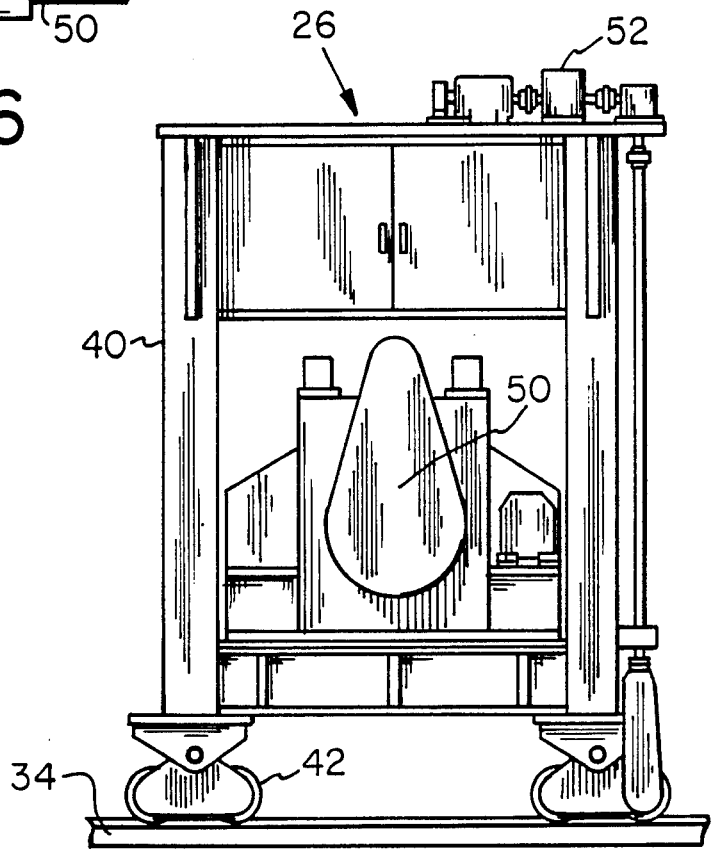
FIG. 5 is a side elevation of one form of coiler.

A coiler 26 for carrying out the process is illustrated in FIGS. 5 and 6. Coiler 26 includes a main frame 40 having wheels 42 operable along the trackway 34. Coiler 26 is driven by carriage drive assembly 52 in timed relationship with the strip as described hereinabove.

Coiler 26 includes a pair of mandrels 44 for gripping the tail end of the transfer bar and rotating so as to create the coil. Mandrels 44 are driven by drive motors 54 and are moved in and out by means of hydraulic cylinder 50 driven by DC drive motor 48. Stripper plates 46 are positioned radially inward of each mandrel 44 so the coil can be stripped from the coiler 26 at the payoff assembly by retraction of the mandrels 44.

It will be recognized that the above described invention may be otherwise embodied within the scope of the appended claims.

We claim:

1. A method of hot rolling strip on a hot strip mill having a roughing mill including at least one roughing stand and at least one finishing stand spaced therefrom and in which a transfer bar having a head end and a tail end exits the roughing stand head end first comprising coiling the transfer bar by initiating coiling at the tail end while moving a movable coiler toward said finishing stand after it exits the roughing mill to form at least a partially formed coil and then decoiling the formed coil.

2. The method of claim 1, including decoiling the said coil into the finishing stand.

3. The method of claim 1, including initiating the coiling of the tail end after the head end has been introduced into the finishing mill.

4. A method of hot rolling strip on a hot strip mill having a roughing train, including at least one roughing stand and a finishing train forming a space therebetween and including at least one finishing stand and in which a transfer bar having a head end and a tail end exits the roughing train comprising providing a coiler movable in said space between a first position adjacent the roughing train and a second position adjacent the finishing train, coiling the transfer bar with the coiler starting with the tail end at the first position while advancing the coiler to the second position and decoiling the transfer bar into the finishing train.

5. The method of claim 4, including initiating coiling after the head end has been introduced into the finishing train.

6. The method of claim 5, including returning the coiler to the first position.

7. A hot strip mill comprising:

A. a roughing train including at least one roll stand for converting a slab to a transfer bar having a head end and a tail end;

B. a finishing train including at least one roll stand for converting the transfer bar to a strip, said finishing train spaced downstream of said roughing train; and C. coiling means located between the finishing train and the roughing train for coiling the transfer bar starting at the tail end, said coiling means having means for moving the coiling means in speed-coordinated relationship with the transfer bar and between a first position adjacent the roughing train and a second position adjacent the finishing train, whereby the transfer bar is coiled concurrently with rolling through the finishing train and a formed coil is thereafter payed off into the finishing train to complete rolling.

8. The hot strip mill of claim 7, including coil payoff means positioned adjacent to and upstream of the finishing train for feeding the coil into the finishing train.

9. The mill of claim 8, said payoff means comprising a plurality of rolls for holding the coil.

10. The mill of claim 8, said payoff means being integral with the coiling means.

11. The mill of claim 7, said means for moving including a coiling machine and a trackway to accommodate the coiling machine extending between the roughing train and the finishing train.

* * * * *